US005121926A

United States Patent [19]

Pfaender

[11] Patent Number: 5,121,926

[45] Date of Patent: Jun. 16, 1992

[54] GAME BOARD

[75] Inventor: Michael V. Pfaender, Toledo, Ohio

[73] Assignee: Sem-Com Col, Inc., Toledo, Ohio

[21] Appl. No.: 747,993

[22] Filed: Aug. 21, 1991

[51] Int. Cl.[5] ..... A63F 3/00

[52] U.S. Cl. ..... 273/236; 40/547; 40/579

[58] Field of Search ..... 273/236, 237, 265, DIG. 7; 434/81, 128, 159, 160, 169; 40/547, 579

[56] References Cited

U.S. PATENT DOCUMENTS

| | | | |
|---|---|---|---|
| 1,845,530 | 2/1932 | Tarallo | 40/547 |
| 1,895,068 | 1/1933 | Borroughs | 434/160 |
| 2,167,660 | 8/1939 | Lauve, Jr. | 40/579 |
| 2,584,601 | 2/1952 | Mauser | 434/159 |
| 2,670,208 | 2/1954 | Wales | 273/237 |
| 3,508,753 | 4/1970 | Mackey | 273/237 |
| 3,530,615 | 9/1970 | Meyer | 40/547 X |
| 3,568,357 | 3/1971 | Lebensfeld | 40/579 X |
| 3,579,856 | 5/1971 | Way | 434/128 |
| 4,196,539 | 4/1980 | Speers | 40/547 X |
| 5,037,105 | 8/1991 | Klein | 273/237 |

*Primary Examiner*—William H. Grieb
*Attorney, Agent, or Firm*—Marshall & Melhorn

[57] ABSTRACT

A game board including a playing surface having a plurality of apertures extending through the entire thickness thereof. An underlay provided with various game-playing indicia is retained beneath the playing surface so that the game-playing indicia contained on the underlay are positioned beneath at least some of the apertures in the playing surface. The game board includes a plurality of light transmitting playing pieces adapted to be received in the apertures formed in the playing surface. The playing pieces contact the underlay and transmit the game-playing indicia from the underlay to the playing surface, thereby displaying the otherwise hidden game-playing indicia to the game players.

12 Claims, 3 Drawing Sheets

GAME BOARD

BACKGROUND OF THE INVENTION

1. Field of the Invention

The present invention relates to game boards, and in particular, to a pegged game board incorporating an encoded underlay which facilitates the movement and positioning of light transmitting playing pieces.

2. Description of Related Art

Conventional game boards generally require the use of predesignated game moves or other functions, and exclusively use dice, spinners, cards and the like for such game functions. This requirement can break up the flow of game play which is essential for certain games where continuous and easy play movement is needed. In addition, the features of most game boards are set; all information contained on the board is either visible and known to all players or, conversely, is hidden and unknown to all players.

Typically, there can be little or no variation in game board function. In a very few games, game board information can be varied. In most of these cases though, the means for making game board changes are physical, such as opening or closing shutters or repositioning game elements by hand. In addition, game information is generally identified by such obviously disadvantageous means as reliance upon one's opponent to indicate correct or incorrect movements.

SUMMARY OF THE INVENTION

Overcoming these difficulties and antiquated game interface mechanisms, the present invention offers a new game board with improved playing piece movement, location and positioning utilizing light transmitting playing pieces. The present invention is comprised of a game board having an upper surface containing a plurality of apertures. Beneath its upper surface, the game board incorporates a reusable and removable underlay containing encoded game-playing information. The encoded underlay is capable of multiple orientations within the game board.

When the encoded underlay is contacted through the game board apertures by light transmitting playing pieces, the encoded game-playing information contained on the underlay is immediately visible to all of the players, providing a continuous game playing function coupled with unique and easy game function variation. The playing pieces are comprised of light transmitting glass, plastic, bundles of glass or plastic fibers, or other suitable material capable of transmitting the encoded game function information from the underlay to game players for game operation.

The principle object of the invention is to provide a light transmitting playing piece pegged game board which provides improved playing piece movement, location and positioning;

A further object is to provide the game board with an encoded, removable and reusable underlay which allows for easy and continuous game play coupled with easy game function variation;

Another object of the invention is to provide light transmitting playing pieces comprised of glass, plastic, bundles of glass or plastic fibers, or other suitable optic materials capable of transmitting and displaying the generally hidden information contained on the encoded game underlay to game players for game playing;

A still further object is to provide a game board comprised of a simple one piece arrangement which allows the underlay to be placed and held in the game board through a built-in slot;

Other objects and advantages will become more apparent during the course of the following description when taken in connection with the accompanying drawings.

BRIEF DESCRIPTION OF THE DRAWING

In the drawings, wherein like numerals refer to like parts throughout.

DESCRIPTION OF THE PREFERRED EMBODIMENTS

Figure 1:
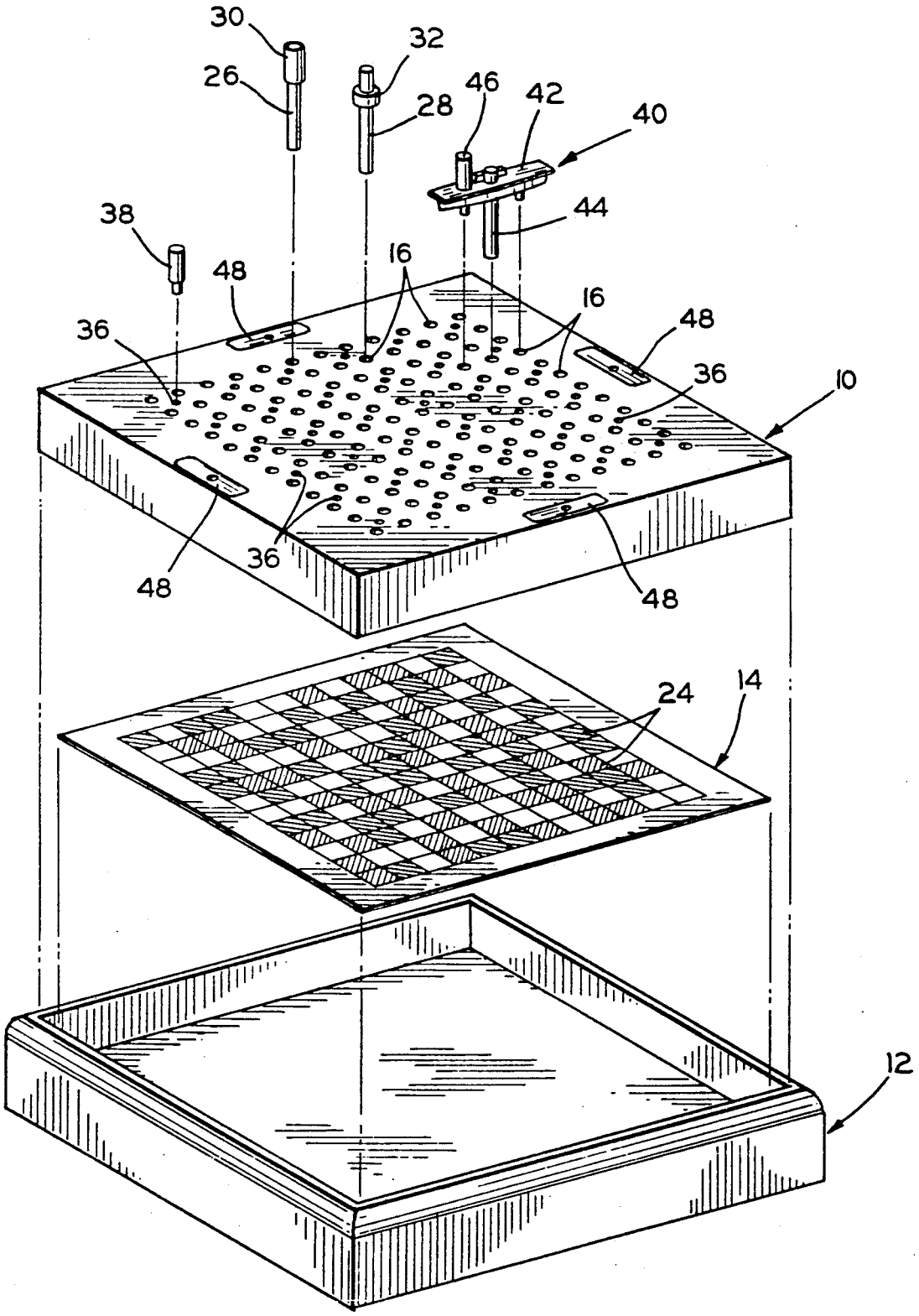
FIG. 1 is an exploded perspective view of one embodiment of the game board of the present invention, including the various playing pieces.

Referring now to the drawings, there is illustrated in FIG. 1 a game board including light transmitting playing pieces in accordance with the present invention. The game board is comprised of a playing board 10 and a cooperating bottom board 12. The playing board 10 is square as shown in the drawings, but may be virtually any shape desired. Whatever the shape of the playing board 10, the bottom board 12 is formed substantially of the same shape as that of the playing board 10. The playing board 10 and bottom board 12 may be made of wood, plastic or any other suitable material. An underlay 14, provided with various game-playing indicia, is retained in position between the playing board 10 and cooperating bottom board 12.

The playing board 10 includes a plurality of apertures 16 extending through the entire thickness of the playing board 10. The apertures 16 in the playing board 10 are adapted to receive a variety of playing pieces, discussed in further detail hereinafter. The apertures 16 in the playing board 10 may be of any number, cross-sectional shape and arrangement desired.

Figure 2:
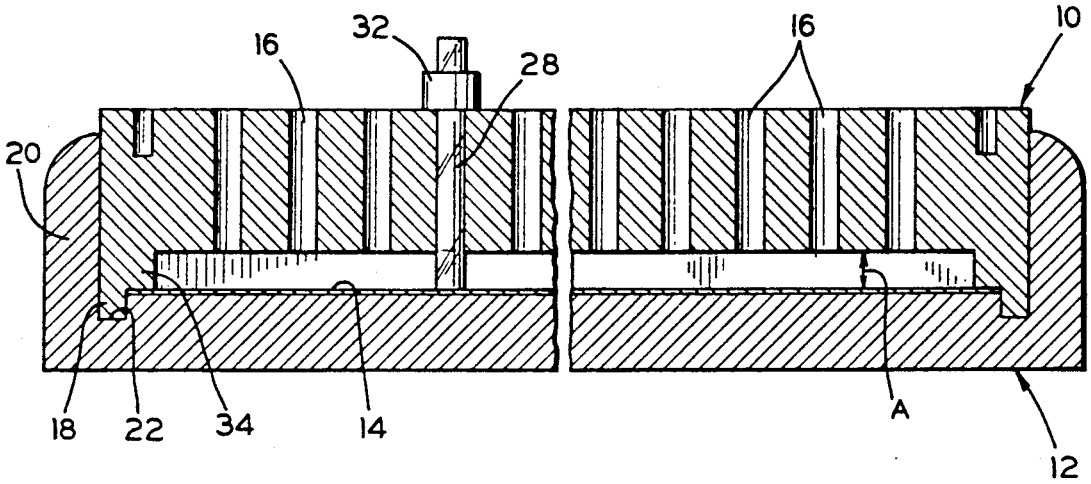
FIG. 2 is a cross sectional view of the game board of FIG. 1.

As is best seen in FIG. 2, the playing board 10 is provided with a downwardly extending rib 18 around its entire periphery, while the bottom board 12 is provided with a cooperating flange 20 around its entire periphery. The flange 20 extends upwardly and is generally normal to the plane of the bottom board 12. The playing board 10 and bottom board 12 fit snugly together, being of such dimensions that the distance between the inner surfaces of the flange 20 of the bottom board 12 is only slightly larger than the distance between the outer surfaces of the rib 18 of the playing board 10. The rib 18 is preferably seated in a channel 22 disposed inwardly of the flange 20 in the bottom board 12.

An encoded underlay 14 is placed and held between the playing board 10 and bottom board 12. The underlay 14 is positioned on the upper surface of the bottom board 12 and the playing board 10 is placed on the bottom board 12 as described above. To aid in the engagement and disengagement of the playing board 10 and bottom board 12, the peripheral edge of the playing board 10 should preferably extend beyond the end of the flange 20, to allow the same to be easily grasped by the user.

Figure 3:
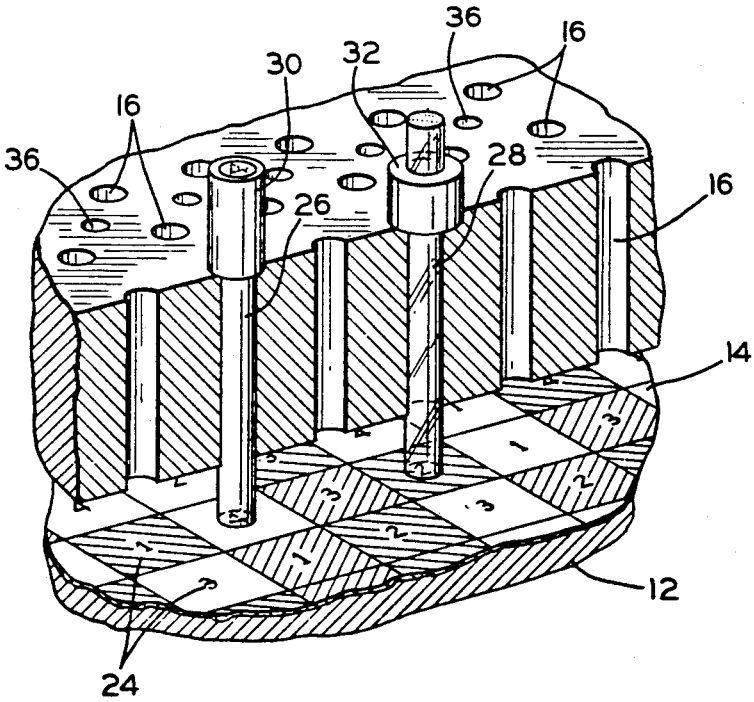
FIG. 3 is a perspective view of a section of the game board which has been cut away to show the light transmitting playing pieces in association with the encoded underlay.

The underlay 14 is provided on one or both of its surfaces with various game-playing information or indicia 24, such as numbers, colors or other suitable information symbols, as shown clearly in FIG. 3. The underlay 14 is positioned relative to the playing board 10 so that the indicia 24 are in alignment directly beneath the apertures 16 formed in the playing board 10. The underlay 14 is removable and may be placed in different orientations relative to the playing board 10 to effectively vary the game-playing information provided thereby.

The underlay 14 is positioned beneath the playing board 10 so that the indicia 24 are not generally visible to the game players. To aid in this, the underlay 14 is preferably held a distance A from the playing board 10 by means of, for example, a step 34 formed in the rib 18 of the playing board 10. The marginal edge of the underlay 14 is held between the step 34 and the bottom board 12, and a space is created between the underlay 14 and the playing board 10. This space serves to diffuse the light transmitted through those apertures 16 in which there is no playing piece so that such indicia 24 is indistinguishable to the game players.

The game board of the present invention utilizes a variety of light transmitting playing pieces to transmit the game-playing indicia 24 from the underlay 14 to the upper surface of the playing board 10 where it is visible to all of the players. As noted above, the indicia 24 are housed beneath the playing board 10 and are normally not visible to the players. The playing pieces may be made of glass, plastic, bundles of glass or plastic fibers such as a fused fiberoptic material, or other suitable light transmitting material. Acrylic has been found to be a suitable light transmitting plastic material. The shape of the cross section of the playing pieces is preferably the same as that of the apertures 16 in the playing board 10. A playing piece 26 made of a fused fiberoptic material and a playing piece 28 made of light transmitting plastic are illustrated in FIG. 3. While the playing pieces 26 and 28 are formed of materials which transmit visible light, suitable materials may be selected which transmit electromagnetic radiation in the wavelength range including infrared, visible, ultraviolet, and X-rays.

The light transmitting playing pieces 26 and 28 are inserted through the apertures 16 formed in the playing board 10 to contact the encoded underlay 14. One end of the respective playing pieces 26, 28 contacts the underlay 14 at a location provided with game-playing indicia 24. Color-coded collars 30 and 32 may be provided on the playing pieces 26 and 28, respectively, to distinguish the playing pieces of the various game players. The collars 30, 32 must be positioned along the length of the playing pieces 26, 28 so as not to prevent the end of the playing pieces 26, 28 from contacting the underlay 14.

Ambient light travels down through the light transmitting playing pieces 26, 28 and the image of the game-playing indicia 24 is reflected back through the playing pieces 26, 28 to the opposite end thereof, where it is displayed. As the length of the playing pieces 26 and 28 is such that one end thereof extends above the upper surface of the playing board 10 when the opposite end is in contact with the underlay 14, the game-playing indicia 24 is visible to all of the players. The game-playing indicia 24 can then be used by the game players to determine game piece movement, positioning and location according to any prescribed set of game rules and regulations.

As noted above, the game-playing indicia 24 may include virtually any conceivable number, letter, color, symbol, or combination thereof, required for the functioning of a particular game. The underlay 14 shown in FIG. 3, for example, is comprised of a matrix of differently colored squares (shown by hatching in the drawings), each square having a numeral placed therein. With regard to game-playing indicia 24 consisting of colors, it has been found that fluorescent colors are most readily transmitted and displayed by the light transmitting playing pieces.

Additionally, depending upon the materials chosen for the various playing pieces 26, 28, and as a part of game function, certain playing pieces may be capable of transmitting only certain of the game-playing indicia 24. For example, the playing piece 26, formed of a fused fiberoptic material, will transmit both the color and numeral portions of the game-playing indicia 24. On the other hand, the playing piece 28, formed of light transmitting plastic of lesser optical quality, may transmit only the color portion of the game-playing indicia 24, the numeral being indistinguishable to the players. The different playing pieces 26 and 28 may thereby be made to perform different functions within the framework of a given game.

To add another feature to game function, the playing board 10 may be provided with a plurality of holes 36 adapted to receive marking pegs 38. Pegs 38 may be used to mark various positions on the playing board 10 in conjunction with the movement and positioning of the playing pieces 26 and 28. The holes 36 need not extend through the entire thickness of the playing board 10, as the pegs 38 are not light transmitting and do not function to display game-playing indicia 24.

Obviously, any number of other game pieces may be added to further vary game function. As an example, a command piece 40, which may be used in a battle-type game, is shown in FIG. 1. The command piece 40 includes a command vessel 42 and a column 44 formed of light transmitting material. The command piece 40 may thereby move in accordance with the various game-playing indicia 24 contained on the underlay 14. The command piece 40 may be adapted to receive pegs 46 to represent, for example, the number of enemy "hits" incurred by the command piece 40. The playing board 10 may be further provided with various positions 48 to act as a base or starting position for the various game players.

Figure 4:
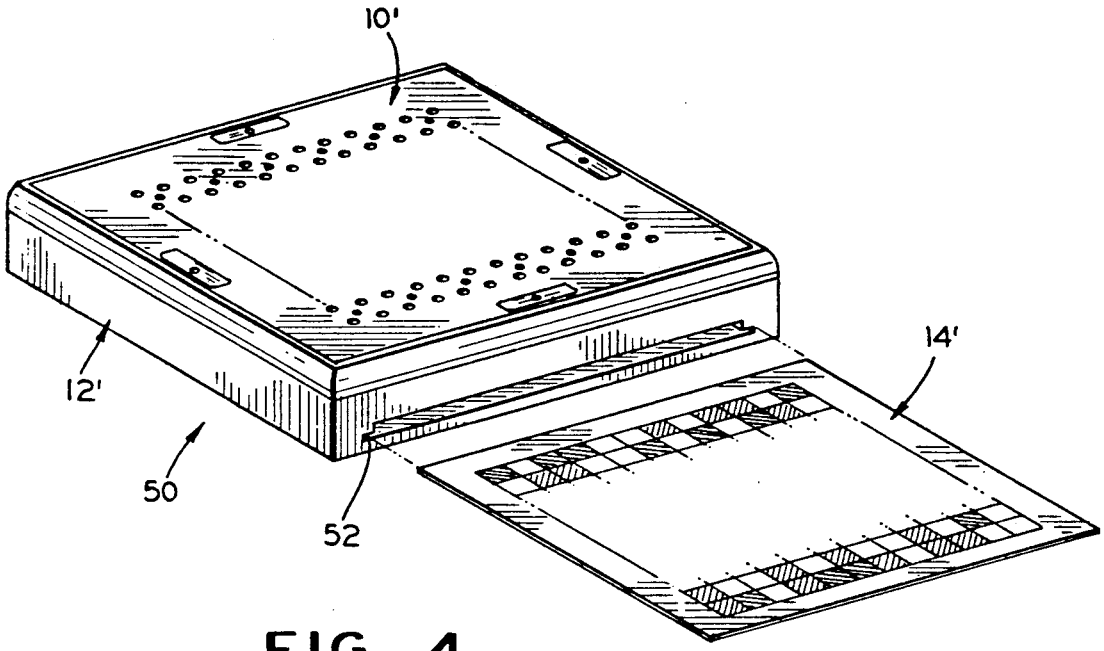
FIG. 4 is a perspective view of a second embodiment of the game board showing a slot for insertion and retention of the underlay.
Figure 5:
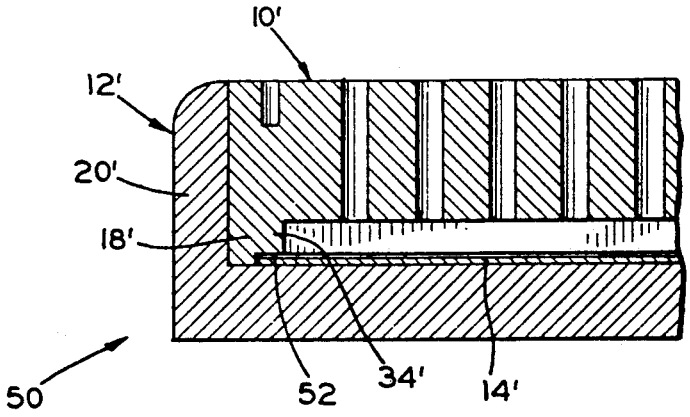
FIG. 5 is a cross sectional view of a part of the game board of FIG. 4.

An alternate embodiment of the invention is illustrated in FIGS. 4 and 5, wherein similar elements have been designated with corresponding prime numerals. The playing board 10' and bottom board 12' are fixed together to form a single piece game board 50. The outer edge of the playing board 10' may be bonded to the flange 20' of the bottom board 12' with adhesive, nails, screws, or any other suitable attachment means.

The game board 50 is provided with a slot 52 adapted to receive the encoded underlay 14' as shown in FIG. 4. The underlay 14' is easily removed and reoriented, or a differently encoded underlay inserted, without having to disengage and then reengage a separate playing board 10' and bottom board 12'.

The underlay 14' is held in position between the step 34' formed in the rib 18' and the upper surface of the bottom board 12'. The distance between the step 34' and the upper surface of the bottom board 12' is preferably only slightly larger than the thickness of the underlay 14', to firmly the hold the underlay 14' in position. As discussed above, a space is created between the playing board 10' and the underlay 14' by the step 34'.

It is to be understood that the form of the invention herewith shown and described is to be taken as illustrative only, and that various changes in the shape, size and arrangement of the elements may be resorted to without departing from the spirit of the invention.

What is claimed is:

1. A game board comprising:

a) a playing board having a top surface and a bottom surface, and including a plurality of apertures extending from the top surface to the bottom surface of said playing board;

b) an underlay provided with various game-playing indicia;

c) means for retaining said underlay adjacent the bottom surface of said playing board so that the game-playing indicia contained on said underlay are positioned beneath at least some of the apertures in said playing board; and d) at least one playing piece adapted to be received in the apertures in said playing board, and capable of transmitting the game-playing indicia from said underlay to the top surface of said playing board, thereby displaying the game-playing indicia to the game players.

2. A game board as defined in claim 1, wherein said playing pieces are comprised of a material which transmits electromagnetic radiation in the wavelength range including infrared, visible, ultraviolet, and X-rays.

3. A game board as defined in claim 1, wherein said playing pieces are comprised of a material which transmits visible light.

4. A game board as defined in claim 2, wherein said playing piece is comprised of a bundle of glass fibers.

5. A game board as defined in claim 4, wherein said playing piece is comprised of a fused fiberoptic material.

6. A game board as defined in claim 2, wherein said playing piece is comprised of glass.

7. A game board as defined in claim 2, wherein said playing piece is comprised of a light transmitting plastic.

8. A game board as defined in claim 7, wherein said playing piece is comprised of acrylic.

9. A game board as defined in claim 1, wherein the game-playing indicia of said underlay is comprised of numbers, letters, symbols, colors or a combination thereof.

10. A game board as defined in claim 1, further comprising means for creating a space between the bottom surface of said playing board and said underlay.

11. A game board as defined in claim 1, further comprising a bottom board in engagement with said playing board, with said underlay positioned therebetween.

12. A game board as defined in claim 11, wherein said bottom board and said playing board are bonded together to form a unitary game board, and wherein said means for retaining said underlay comprises a slot formed in said unitary game board.

* * * * *